United States Patent [19]

Suzuki

[11] Patent Number: 4,920,848

[45] Date of Patent: May 1, 1990

[54] MUSICAL WEAR

[75] Inventor: Hideo Suzuki, Hamamatsu, Japan

[73] Assignee: Yamaha Corporation, Hamamatsu, Japan

[21] Appl. No.: 161,176

[22] Filed: Feb. 26, 1988

[30] Foreign Application Priority Data

Feb. 27, 1987 [JP] Japan ..... 62-44234
Feb. 27, 1987 [JP] Japan ..... 62-44233

[51] Int. Cl.[5] ..... G10H 1/06; G10H 1/18

[52] U.S. Cl. ..... 84/600; 84/658; 84/659; 84/670; 341/27

[58] Field of Search ..... 200/DIG. 2; 335/2; 84/1.01, DIG. 7, DIG. 8, 1.19, 1.24, 600, 658, 659, 670; 2/159; 273/183 R, 183 B; 341/20, 27

[56] References Cited

U.S. PATENT DOCUMENTS 1,197,652 9/1916 Newton ..... 200/DIG. 2 X
1,527,792 2/1925 French ..... 200/DIG. 2 X
1,906,193 4/1933 Vitale ..... 200/DIG. 2 X
3,383,487 5/1968 Wiener ..... 335/2
4,527,456 7/1985 Perkins et al. ..... 84/1.24 X
4,538,495 9/1985 Sato ..... 84/1.19
4,635,516 1/1987 Giannini ..... 84/DIG. 8

*Primary Examiner*—Stanley J. Witkowski
*Attorney, Agent, or Firm*—Spensley Horn Jubas & Lubitz

[57] ABSTRACT

A finger switch is mounted at a player's finger so as to detect bending and stretching actions of a player's finger. Such finger switch at least consists of a thin plate made of plastic materials which is mounted on the back of the player's finger, a push button mounted on the thin plate near a center portion of the player's finger and a movable member which can be moved along the thin plate in response to the bending and stretching actions of the player's finger. When the player bends his finger, the movable member is moved toward the push button so that the push button will be pushed by the movable member. By mounting a plurality of such finger switches on the fingers of the player, a musical scale or a tone pitch of a musical tone to be generated can be controlled based on a combination of on/off states of the push buttons.

6 Claims, 3 Drawing Sheets

| | RIGHT HAND | | | LEFT HAND | |
|---|---|---|---|---|---|
| | INDEX FINGER | MIDDLE FINGER | THIRD FINGER | INDEX FINGER | MIDDLE FINGER |
| DO | × | × | × | × | × |
| RE | ○ | × | ○ | | |
| MI | ○ | ○ | × | | |
| FA | ○ | × | × | | |
| SO | × | × | × | × | ○ |
| LA | ○ | ○ | × | | |
| SI | × | ○ | × | | |
| DO | × | × | × | ○ | × |
| RE | ○ | × | × | | |
| MI | × | × | × | ○ | ○ |
| FA | ○ | × | × | | |

○ : ON
× : OFF

MUSICAL WEAR

BACKGROUND OF THE INVENTION

The present invention generally relates to a finger switch, and more particularly to a finger switch which is turned on and off in response to bending and stretching actions of a player's finger so that a musical tone will be generated.

Conventionally, the player inputs performance information to a musical instrument by use of an input apparatus such as a keyboard, so that the musical instrument generates a musical tone having a desirable tone pitch, a desirable tone color and the like.

SUMMARY OF THE INVENTION

It is accordingly a primary object of the present invention to provide a finger switch which is driven on and off in response to the bending and stretching actions of the player's finger so that a melody tone having a desirable musical scale can be generated without using the input apparatus such as the keyboard, for example.

In a first aspect of the invention, there is provided a finger switch comprising: (a) a thin plate made of bendable materials, one edge of the thin plate being mounted near a finger base portion of a player's finger, while another edge of the thin plate is stretched toward a finger tip edge portion of the player's finger, whereby the thin plate can be bent and stretched in response to bending and stretching actions of the player's finger; (b) a gate member having a gate shape, the gate member being mounted between said finger base and said finger tip edge of the player's finger, whereby the thin plate is inserted through inside of the gate member; (c) a contact mounted at the gate member in a direction of the finger tip edge portion; and (d) a contact driving member mounted to the thin plate at a point near the finger tip edge of the plate, the contact driving member driving the contact to turn on and off in response to the bending and stretching movement of the thin plate.

In a second aspect of the invention, there is provided a musical tone generating apparatus comprising: (a) a plularity of detectors each mounted at a player's finger for detecting bending and stretching actions of the player's finger; (b) musical tone data generating means for converting detecting results of the contacts into musical tone data representative of a specific musical tone; and (c) musical tone signal generating means for converting the musical tone data into a musical tone signal, whereby a musical tone corresponding to the musical tone signal is to be generated.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENT

Figure 1:
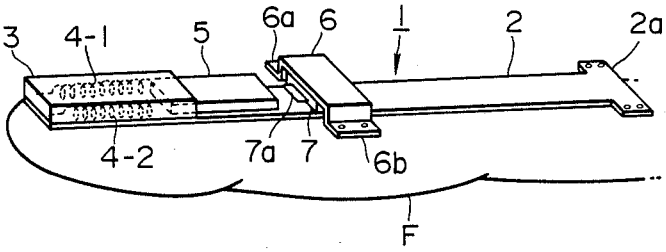
FIG. 1 is a perspective side view showing an embodiment of the finger switch mounted on the player's finger.

Referring now to the drawings, wherein like reference characters designate like or corresponding parts throughout the several views, FIG. 1 is a perspective side view showing an embodiment of the finger switch 1. As shown in FIG. 1, the finger switch 1 is mounted at a certain portion of a mounting member F such as a glove, and such certain portion corresponds to the back of the player's finger. First, a rectangular thin plate 2 is made of plastic (or bendable) material, and a fixing portion 2*a* is mounted to a base of a finger portion of the glove F. In addition, a cylinder 3 having an opening in a direction of the fixing portion 2*a* is mounted at an edge portion of the thin plate 2 which is turned in a finger tip direction. Further, springs 4-1 and 4-2 are provided within the cylinder 3. First edges of the springs 4-1 and 4-2 are fixed at a bottom portion of the cylinder 3, and second edges of such springs are fixed at an edge of a movable element 5. These springs 4-1 and 4-2 push the movable element 5 so that the movable element 5 can be freely slid into and out of the cylinder 3. When the glove F is mounted by the player's hand, fixing portions 6*a* and 6*b* mount a gate member 6 to the glove F at a position between a first joint and a second joint of the player's finger. In case of a player's thumb, the fixing portions 6*a* and 6*b* mount the gate member 6 to the glove F at a position between a tip edge and a joint of the player's thumb. This gate member 6 has a gate shape so that a center portion of the thin plate 2 can be inserted through the gate member 6. A push switch 7 having a push button 7*a* is mounted at an inside plane of the gate member 6 so that the push button 7*a* is turned in the finger tip direction.

Figure 2:
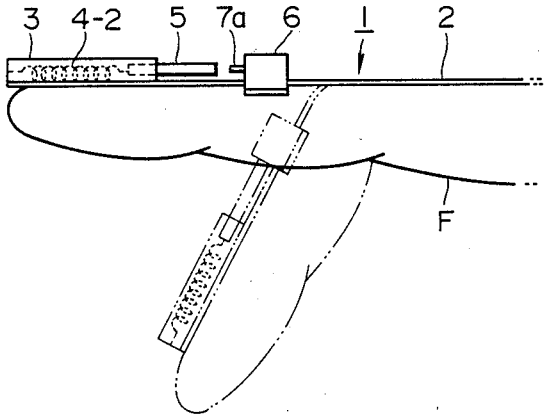
FIG. 2 is side view showing the finger switch which is operated in response to the bending and stretching actions of the player's finger.

The finger switch 1 is constructed as described heretofore. When the player bends his finger at the first joint as shown in FIG. 2, the movable element 5 moves so that the edge of the movable element 5 will push the push button 7*a* and the push button 7*a* will be turned on. Thereafter, when the player stretches his finger, the movable element 5 moves back to an original position so that the push button 7*a* will be turned off. In this case, at a time when the player bends his finger by a predetermined angle and more, the movable element 5 pushes against elastic restoring force of the springs 4-1 and 4-2 so that the movable element 5 can be slid into the bottom portion of the cylinder 3. For this reason, there is no un-natural movement so that the bending action of the player's finger is not stopped at a predetermined angle.

Figure 3:
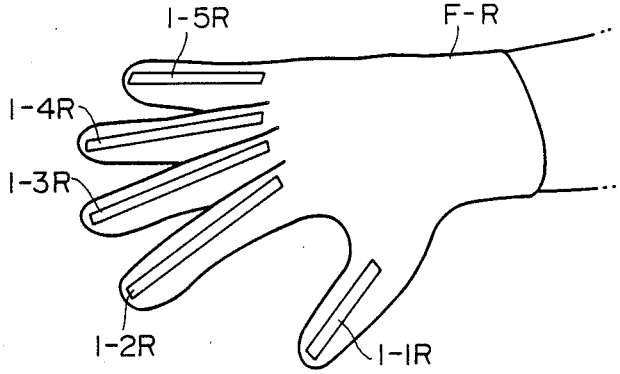
FIG. 3 is a perspective side view showing a glove for a player's right hand mounted with finger switches.
Figure 4:
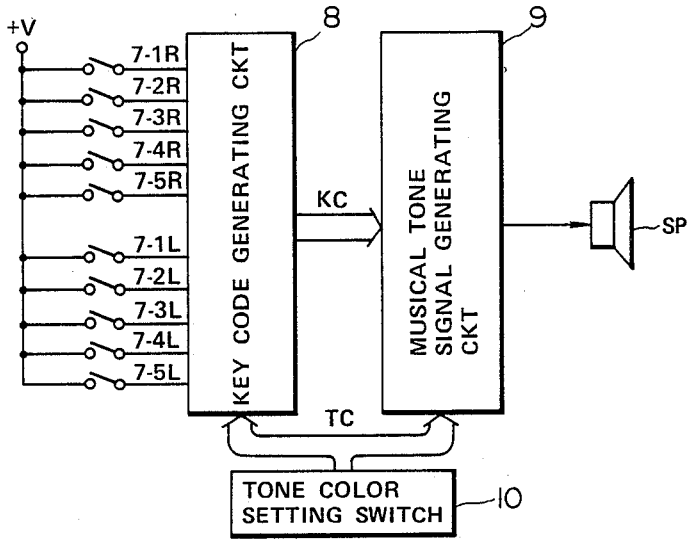
FIG. 4 is a block diagram showing a musical tone generating apparatus using finger switches.

Next, description will be given with respect to an example of the musical tone generating apparatus which employs the finger switch 1 in conjunction with FIGS. 3 and 4. FIG. 3 shows the glove F-R mounted on the player's right hand, and FIG. 4 shows an electric constitution of the musical tone generating apparatus. In addition, another glove for a player's left hand is constructed as similar to the glove F-R shown in FIG. 3, hence, description and drawing thereof will be omitted.

As shown in FIG. 3, five finger switches 1-1R to 1-5R each having the similar construction of the finger switch 1 are respectively mounted at five finger portions of the right glove F-R. These finger switches 1-1R to 1-5R respectively provide push switches 7-1R to 7-5R each having the similar construction of the push switch 7. Similarly, five push switches 7-1L to 7-5L are respectively provided at five finger switches mounted at five finger portions of the left glove (not shown). First terminals of the ten push switches 7-1R to 7-5R and 7-1L to 7-5L are respectively connected to a key code generating circuit 8, and constant voltage +V is supplied to second terminals of these ten push switches. This key code generating circuit 8 inputs on/off states of these ten push switches 7-1R to 7-5R and 7-1L to 7-5L and also inputs a tone color code TC which is set by a tone color setting switch 10 arranged on a panel face (not shown). Based on the inputted on/off states and the tone color code TC, the key code generating circuit 8 generates a key code KC.

Figure 5:
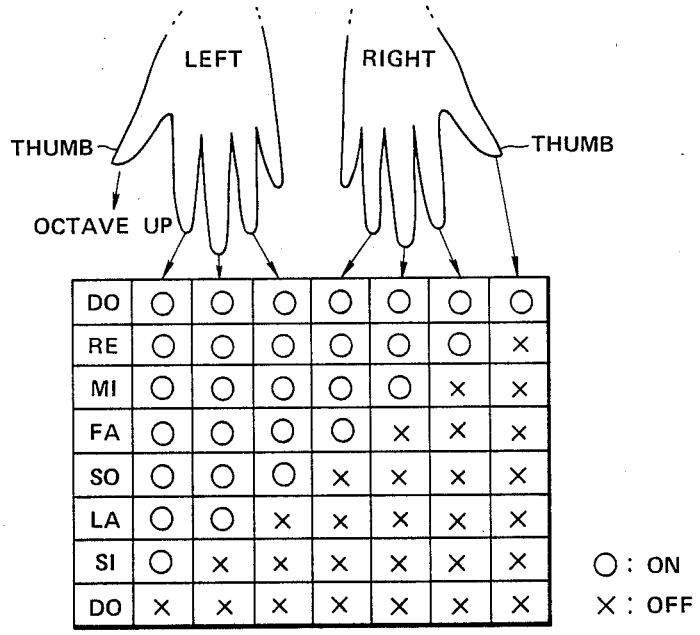
FIG. 5 shows relations between operations of player's fingers and musical scales in case of a saxophone.
Figures 6, 7:
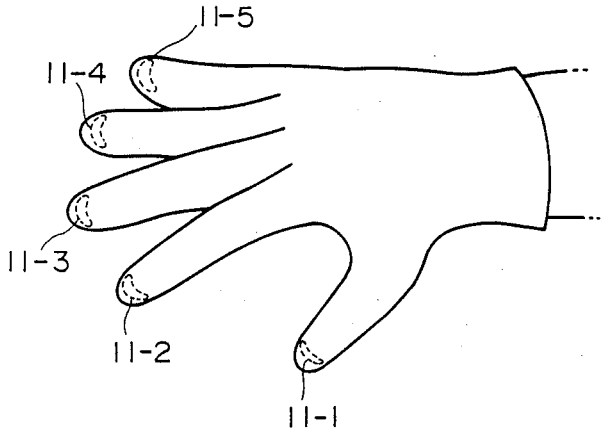
FIG. 6 shows relations between operations of player's fingers and musical scales in case of a trumpet.
FIG. 7 is a perspective side view showing another glove for the player's right hand mounted with finger switches

More specifically, FIG. 5 shows relations between the on/off states of the push buttons and the musical scales of the saxophone. In FIG. 5, a circle-mark represents that each push button is turned on, while a X-mark represents that each push button is turned off. In response to the operations of the finger switches, the key code generating circuit 8 generates the key code KC corresponding to one of the musical scales do, re, mi, fa, so, la, si and do. In this case, an octave number is changed in response to the on/off state of the push switch 7-1L for the player's left thumb, so that the value of the key code KC is changed. On the other hand, FIG. 6 shows relations between the operations of the player's fingers and musical scales of the trumpet, and such relations for the trumpet are different from those of the saxophone. Next, the key code KC generated in the key code generating circuit 8 is sequentially outputted to a musical tone signal generating circuit 9. This musical tone signal generating circuit 9 inputs the key code KC and the tone color code TC, whereby the musical tone signal generating circuit 9 generates a musical tone signal having a musical size corresponding to the key code KC and a tone color corresponding to the tone color code TC. Such musical tone signal drives a speaker SP.

When the player selects one of the tone colors of the saxophone and the trumpet by using the tone color setting switch 10, the musical tone signal generating circuit 9 inputs the tone color code TC as the set tone color so as to selectively change the tone color of the musical tone to be generated. In addition, the speaker SP generates a melody tone having the tone color of the saxophone or the trumpet by operating the player's fingers in accordance with finger operations shown in FIG. 5 or 6.

In the present embodiment, the tone pitch of the musical tone is controlled in response to the movement of the player's finger. However, the present invention is not limited to that. Hence, it is possible to control a generation of a rhythm tone such as a tone of a percussion musical instrument. In addition, instead of using the finger switch 1, it is possible to employ pressure sensitive elements 11-1 to 11-5 at the finger portions of the glove as shown in FIG. 7. In response to depressing pressure applied to each pressure sensitive element, intrinsic resistance of each pressure sensitive element varies. Therefore, an output level of each pressure sensitive element varies in accordance with the bending and stretching actions of the player's fingers. In this case, it is possible to generate on/off signals based on the output levels of the pressure sensitive elements 11-1 to 11-5 and then supply such on/off signals to the key code generating circuit 8.

In addition, the contact of the finger switch 1 are turned on and off by bending and stretching the player's finger at the first finger joint. However, the present invention is not limited to that. Hence, it is possible to mount the finger switch 1 to the glove so that the contact of the finger switch 1 can be turned on and off by bending and stretching the player's finger at the base finger portion. In addition, the exposed finger switch 1 is mounted at the back of the finger portion of the glove F in the present embodiment. Instead, it is possible to cover the finger switch 1 by a cloth in order that the finger switch 1 is not exposed to the air. Further, instead of mounting the finger switch 1 to the glove F, it is possible to mount the finger switch directly on the player's finger by use of a band.

As described heretofore, it is possible to freely generate the melody tone having the desirable musical scale by using the finger switch and moving the player's finger, for example. In this case, it is not necessary to use the input apparatus such as the keyboard. In addition, it is possible to input movements of the player's fingers in a performance of a clarinet as performance information of an electronic musical instrument other than the clarinet, for example.

This invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. A musical tone generating apparatus comprising:

(a) a plurality of detectors each mounted at a player's finger for detecting bending and stretching actions of the player's finger;

(b) musical tone data generating means for converting detected results of said detectors into musical tone data representative of a specific musical tone based on a combination of the bent or stretched fingers such that a player can designate a number of musical tones greater than the number of detectors; and (c) musical tone signal generating means for converting said musical tone data into a musical tone signal, whereby a musical tone corresponding to said musical tone signal is generated.

2. A musical tone generating apparatus according to claim 1, wherein said detector is a finger switch comprising:

(a) a thin plate made of plastic material, one edge of said thin plate being mounted near a finger base portion of the player's finger, while an opposite edge of said thin plate is stretched toward a finger tip edge portion of the player's finger, whereby said thin plate can be bent and stretched in response to bending and stretching actions of the player's finger;

(b) a gate member having a gate shape, said gate member being mounted near a center portion of the player's finger, whereby said thin plate is inserted through an opening of said gate member;

(c) a contact mounted at said gate member in a direction of the finger tip edge portion; and (d) a contact driving member mounted at said opposite edge of said thin plate, said contact driving member driving said contact to turn on and off in response to the bending and stretching movement of said thin plate.

3. A musical tone generating apparatus according to claim 1, wherein said detector is a pressure sensitive element for detecting pressure applied thereto by a finger tip edge of the player's finger, so that the bending and stretching actions of the player's finger can be detected by said pressure sensitive element.

4. A musical tone generating apparatus according to claim 1 further comprising tone color setting means for selectively setting one of a predetermined tone colors as a tone color of said musical tone to be generated.

5. A musical tone generating apparatus according to claim 1, wherein said musical tone data generating means generates musical tone data having a musical scale or a tone pitch corresponding to a combination of said detecting results of said detectors.

6. A musical tone generating apparatus according to claim 1, wherein a predetermined detector mounted at a predetermined player's finger changes on octave number of said musical tone when said predetermined detector detects the bending action of the predetermined player's finger, wherein a combination of said detected results, of said detectors other than said predetermined detector designates a musical scale or a tone pitch of said musical tone.

* * * * *